US009493221B2

(12) United States Patent
Cordell

(10) Patent No.: US 9,493,221 B2
(45) Date of Patent: Nov. 15, 2016

(54) TILLER EXTENSION HANDLES

(71) Applicant: Dale M. Cordell, McMinnville, OR (US)

(72) Inventor: Dale M. Cordell, McMinnville, OR (US)

( * ) Notice: Subject to any disclaimer, the term of this patent is extended or adjusted under 35 U.S.C. 154(b) by 71 days.

(21) Appl. No.: 14/499,601

(22) Filed: Sep. 29, 2014

(65) Prior Publication Data

US 2015/0094156 A1 Apr. 2, 2015

Related U.S. Application Data

(60) Provisional application No. 61/884,312, filed on Sep. 30, 2013.

(51) Int. Cl.

| | |
|---|---|
| ***B25G 1/04*** | (2006.01) |
| ***B63H 20/00*** | (2006.01) |
| ***B25G 3/38*** | (2006.01) |
| *B63H 20/12* | (2006.01) |
| *G05G 1/04* | (2006.01) |

(52) U.S. Cl.

CPC ..... *B63H 21/265* (2013.01); *B25G 1/04* (2013.01); *B25G 3/38* (2013.01); *B63H 20/12* (2013.01); *G05G 1/04* (2013.01)

(58) Field of Classification Search

CPC ..... B63H 21/265; B63H 20/12; B25G 1/04; B25G 3/38; G05G 1/04

USPC ..... 74/492

See application file for complete search history.

(56) References Cited

U.S. PATENT DOCUMENTS

| | | | | |
|---|---|---|---|---|
| 3,456,525 A * | 7/1969 | Oldham | B63H 21/265 74/480 R |
| 4,197,764 A * | 4/1980 | Auernhammer | A01G 3/053 16/426 |
| 4,263,864 A * | 4/1981 | Carter, Jr. | A01K 77/00 114/221 R |
| 4,624,206 A * | 11/1986 | Frye | B63H 20/007 114/146 |
| 4,916,969 A * | 4/1990 | Henning | B63H 20/007 114/144 R |
| 5,040,432 A * | 8/1991 | Carlstedt | B63H 21/265 74/480 B |

(Continued)

OTHER PUBLICATIONS

Ironwood Pacific Outdoors, "HelmsMate | Tiller Extension Handle | Outboard Tiller Extension," www.ironwoodpacific.com/store/p/467-HelmsMate-Outboard-Tiller-Extension-Handles.aspx, 1 page, originally retrieved Sep. 6, 2013.

(Continued)

*Primary Examiner* — Karen Beck

(74) *Attorney, Agent, or Firm* — Dascenzo Intellectual Property Law, P.C.; David S. D'Ascenzo

(57) ABSTRACT

Tiller extension handles for watercraft motors comprise a motor coupling mechanism configured to selectively couple the tiller extension handle to a tiller of a motor, and comprise a shaft coupled to the motor coupling mechanism. Tiller extension handles may comprise an accessory (such as a boat hook, brush, net, pole, paddle, and the like) and/or an accessory coupling mechanism (configured to couple an accessory to the tiller extension handle). Further, tiller extension handles may comprise a flexible joint interconnecting the shaft and the motor coupling mechanism, and optionally may include a joint lock-out device to selectively restrict flexing of the flexible joint. Moreover, tiller extension handles may be configured to separate into a tiller section (configured to be coupled to the motor) and an accessory section (including the accessory and/or configured to be coupled to the accessory).

24 Claims, 6 Drawing Sheets

(56) References Cited

U.S. PATENT DOCUMENTS

| | | | | |
|---|---|---|---|---|
| 5,046,974 | A * | 9/1991 | Griffin, Jr. | B63H 25/08 440/63 |
| 5,181,869 | A * | 1/1993 | Dantono | B63H 21/265 114/144 R |
| 5,660,132 | A * | 8/1997 | Pasley | B63H 20/007 114/144 R |
| 5,669,322 | A * | 9/1997 | Huzjak | B63H 20/007 114/146 |
| 6,213,821 | B1 * | 4/2001 | Bernloehr | B63H 20/007 440/59 |
| 6,715,438 | B1 * | 4/2004 | Hundertmark | B63H 20/12 114/144 R |
| 2009/0170382 | A1 * | 7/2009 | Cromartie | B63H 19/08 440/36 |
| 2011/0083865 | A1 * | 4/2011 | Sedmak | A01B 1/065 172/15 |
| 2011/0232436 | A1 * | 9/2011 | Morabit | A01D 34/902 83/13 |
| 2012/0034828 | A1 * | 2/2012 | White | B63H 20/007 440/53 |
| 2014/0294496 | A1 * | 10/2014 | Gardiner | F16B 7/1454 403/374.2 |
| 2015/0034391 | A1 * | 2/2015 | McLain | A01B 33/028 175/162 |
| 2015/0094156 | A1 * | 4/2015 | Cordell | B25G 1/04 464/51 |
| 2015/0111447 | A1 * | 4/2015 | Sacker | B63H 20/14 440/49 |
| 2016/0001845 | A1 * | 1/2016 | Becker | B62K 25/02 301/125 |

OTHER PUBLICATIONS

Ironwood Pacific Outdoors, "HelmsMate Tiller Extension Handle Frequently Asked Questions," www.ironwoodpacific.com/Shared/resources/boating/tiller_extension_handles/helmsmate_common_questions.pdf, 1 page, retrieved Sep. 6, 2013.

* cited by examiner

TILLER EXTENSION HANDLES

RELATED APPLICATION

This application claims priority under 35 U.S.C. §119(e) to U.S. Provisional Patent Application No. 61/884,312, which was filed Sep. 30, 2013, the complete disclosure of which is incorporated herein by reference.

FIELD

The present disclosure relates to tiller extension handles.

BACKGROUND

Watercraft may include a motor for main propulsion and/or for trolling (typically low speed operation). The motor may be used to propel and direct travel of the watercraft. Many outboard motors and trolling motors (which may be collectively referred to herein simply as outboard motors) include a tiller to receive operator inputs selecting the direction and/or magnitude of the motor's thrust. A tiller typically is a relatively short (about 8-18", about 20-45 cm) handle that extends from the body of the motor and provides a lever by which a user may adjust at least the orientation of the motor's propeller (i.e., to direct the thrust of the motor), and thus guide the watercraft. Some motors may incorporate speed control to permit the operator to select the magnitude of the motor's thrust, and some such motors permit the motor's speed to be regulated by an operator conveying inputs to the motor via the tiller. For example, an operator may increase or decrease the magnitude of the motor's thrust by selectively rotating (i.e., twisting) the tiller, or at least a rotatable speed-selection portion thereof, about its longitudinal axis. An outboard motor may include other controls, such as a kill switch, which when actuated, immediately stops operation of the motor, and some outboard motor tillers include such a kill switch.

Outboard motors typically are mounted at the stern of the watercraft, e.g., on the transom. Some outboard motors, such as trolling motors in particular, may be mounted at the bow of the watercraft. Operation of an outboard motor with the tiller requires the watercraft operator (sometimes called the helmsman) to remain within arm's length of the motor. Hence, the operator may be required to twist and/or sit in awkward positions during motor operation. The operator also may be required to be near the motor regardless of the weight balance of the watercraft and its cargo. Hence, operation of a motor with the tiller may leave the watercraft unbalanced and less stable.

To improve operator comfort and safety, an outboard motor may be operated remotely, e.g., through actuators, remote switches, and mechanical extensions. One type of mechanical extension, a tiller extension handle, connects to the tiller to provide a longer tiller handle to the motor. A tiller extension handle may provide an operator with increased leverage when applying steering forces to the tiller and may permit the operator to convey inputs to the motor, via the tiller, from greater distances than if the tiller extension handle were not utilized. However, at longer lengths, operation of the motor may become cumbersome because redirecting the motor may require moving the end of the handle a large distance. Some tiller extension handles incorporate a joint in the shaft of the handle. Including such a joint may enable more convenient operation of the motor from farther away. When a tiller extension handle incorporates a joint, the joint is typically a hinge and link design, which may form a universal joint. Because these designs incorporate bearing surfaces that move against each other, these designs are susceptible to fouling (including corrosion) and ultimately failure (seizure or breakage) due to extended environmental degradation and/or contamination. Hence, there is a need for tiller extension handles with reliable joints.

Further, watercraft have limited space for equipment and gear, such as tiller extension handles, nets, boat hooks, brushes, fishing/sporting equipment, etc. Hence, there also is a need for space-saving, multi-purpose tiller extension handles.

SUMMARY

Tiller extension handles for watercraft motors comprise a motor coupling mechanism, and a shaft that is coupled to the motor coupling mechanism. The motor coupling mechanism is configured to selectively couple the tiller extension handle to a tiller of a motor Tiller extension handles may comprise an accessory (such as a boat hook, a boat brush, a paddle, a gaff, a net, and/or a pole) and/or an accessory coupling mechanism that is configured to couple an accessory to the tiller extension handle.

Further, tiller extension handles may comprise a flexible joint interconnecting the shaft and the motor coupling mechanism. The flexible joint may include a universal joint and/or a unitary joint configured to bend around the elongate direction of the tiller extension handle. Unitary joints may include no bearing, sliding, or rolling surfaces. A tiller extension handle that includes a flexible joint optionally may further include a joint lock mechanism, or joint lock-out device, that is configured to selectively restrict flexing, or bending, or other adjustment of the joint that otherwise would permit the orientation of the shaft to be adjusted relative to the motor coupling mechanism.

Moreover, tiller extension handles may be configured to separate into a tiller section (configured to be coupled to the motor) and an accessory section (including the accessory and/or configured to be coupled to the accessory).

DESCRIPTION

Figure 1:
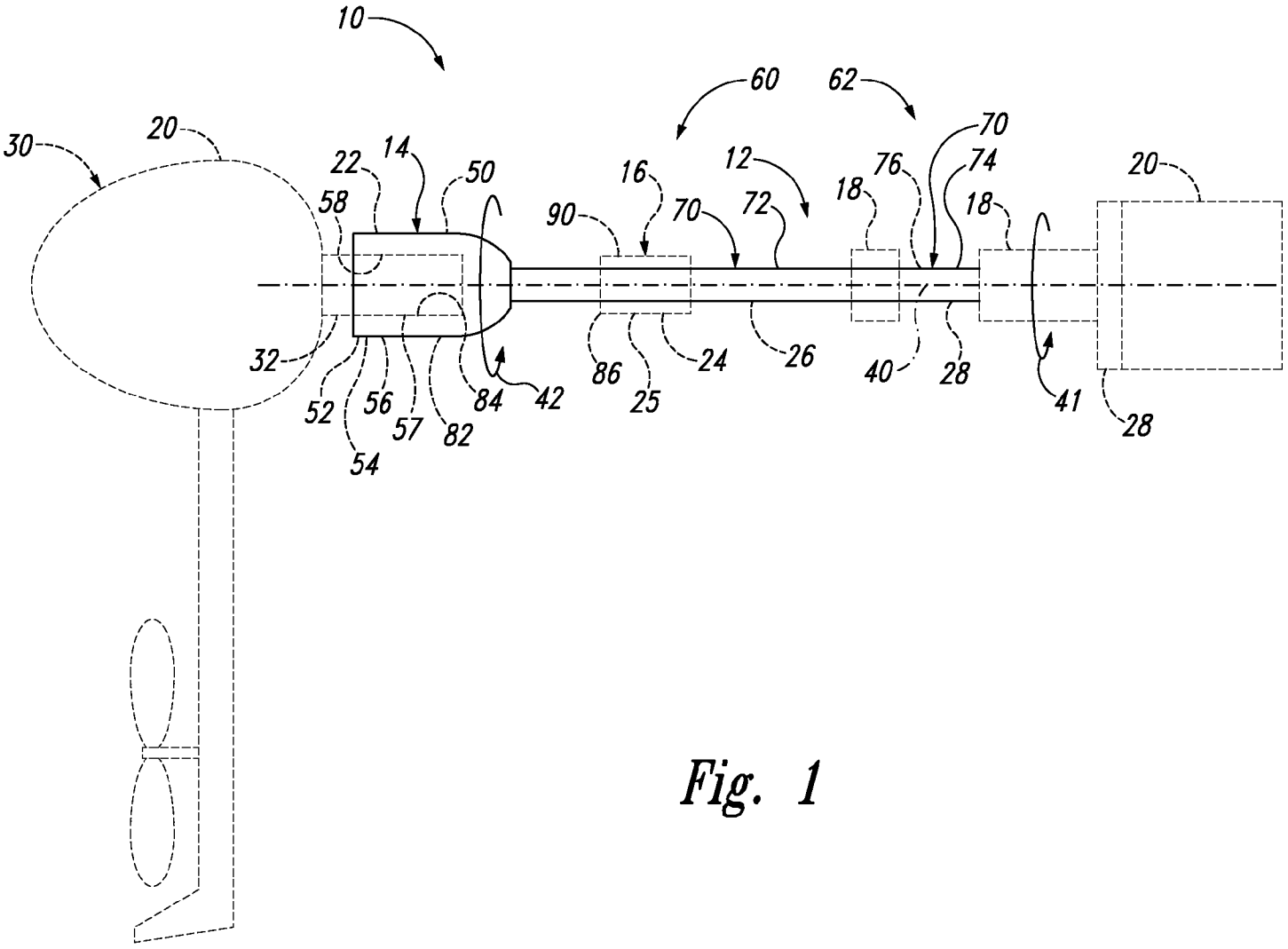
FIG. 1 is a schematic representation of tiller extension handles according to the present disclosure.

FIGS. 1-9 schematically represent examples of tiller extension handles 10 and components thereof according to the present disclosure. In general, in the drawings, elements that are likely to be included in a given embodiment are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labeled with numbers consistent among the figures. Like numbers in each of the figures, and the corresponding elements, may not be discussed in detail herein with reference to each of the figures. Similarly, all elements may not be labeled in each of the figures, but reference numerals associated therewith may be used for consistency. Elements, components, and/or features that are discussed with reference to one or more of the figures may be included in and/or used with any of the figures without departing from the scope of the present disclosure.

FIG. 1 schematically illustrates examples of tiller extension handles 10 according to the present disclosure. The tiller extension handles include a shaft 12 and a motor coupling mechanism 14 that is configured to selectively couple the tiller extension handle to a watercraft motor 30 so that operator inputs (i.e., operator-imparted forces) to the tiller extension handle are conveyed to the motor.

Tiller extension handles 10 are configured to be selectively and operatively coupled to motor 30, such as to a tiller 32 thereof, by motor coupling mechanism 14. Once coupled to the motor 30, tiller extension handles 10 provide positive control of the motor (at least steering) from farther away from the motor than a conventional tiller 32 may allow. Thus, the tiller extension handle is generally elongated along an elongate direction 40 that defines the longitudinal axis of shaft 12. In use, the tiller extension handle typically extends in a generally horizontal direction from the motor. Use of tiller extension handle 10 may allow an operator to operate the motor and control the watercraft from a more comfortable, more stable, and/or more balanced position within the watercraft.

Tiller extension handles 10 are operatively connected to the motor 30 via the motor coupling mechanism 14. Although not required, motor coupling mechanism 14 may be configured to be secured to, to receive, to be received by, to extend around, and/or otherwise to be coupled to the tiller, such as to an end region that is distal to the body of the motor. The motor coupling mechanism operatively couples the shaft 12 of the tiller extension handle 10 to the motor 30. The motor coupling mechanism may be configured for operation of the motor, thereby providing a mechanism for an operator to control the motor position (e.g., left-right for steering) and/or speed by conveying inputs (i.e., forces) to the motor via the shaft of the tiller extension handle. Generally, the motor coupling mechanism is configured to operate the motor through the tiller extension handle without impeding the function of the motor. For example, the motor coupling mechanism may be configured to transmit a twist from the extension handle to the motor's speed control (e.g., the tiller handle). Further, the motor coupling mechanism may be configured to dampen vibrations from the motor (e.g., reducing the transmission of high and/or low frequency motion imparted by the motor through the tiller extension handle to the operator). Vibration dampening may be achieved by incorporating elastomeric materials. The motor coupling mechanism may be configured to allow access to motor controls that do not extend through the tiller extension handle (e.g., by defining an access window, or access passage, 56). As an example, when tiller extension handle 10 is operatively coupled to tiller 32, access window 56 may permit a user to access a kill switch 57 on a portion of the tiller that otherwise would be obstructed.

Motor coupling mechanisms 14 may be configured for ease of coupling and uncoupling. For example, although not required, motor coupling mechanisms may be configured to connect and to disconnect from the motor 30 without requiring the operator to utilize any tools. As examples, the motor coupling mechanism 14 may include and/or utilize at least one bolt, pin, twist-lock, snap-lock, spring, clamp, barb, taper, and/or similar coupling mechanism to selectively connect the tiller extension handle to the tiller. As another example, motor coupling mechanism 14 may include a clamping mechanism 50 that is configured to releasably snap, interlock, or otherwise clamp the tiller extension handle to tiller 32. When present, clamping mechanism 50 may include a clamp shell 82, configured to fit around, next to, and/or within the tiller, and may include a fastener 22 and/or a fastener receiver 54, configured to close the clamping mechanism tightly around, and/or tighten the motor coupling mechanism 14 to, a portion of the tiller, and thereby secure the motor coupling mechanism to the tiller 32. The clamp shell 82 may include and/or be a tubular and/or ring-shaped body configured to at least partially encircle the tiller. Examples of clamping mechanisms 50 include screw (worm gear) clamps, band clamps, spring clamps, wire clamps, ear clamps, pole clamps, and tube clamps. Fasteners 22 and fastener receivers 54 may include and/or be any suitable fastener and/or fastener receiver, such as screws and nuts, pins and sockets, hooks, loops, snaps, clips, and/or magnets. Fasteners 22 may be configured for easy coupling (e.g., clamping) and uncoupling (e.g., unclamping) of the motor coupling mechanism and/or the clamping mechanism. For example, the fastener 22 may be configured to be tightened and/or loosened by hand, and/or without requiring the use of tools, and the fastener 22 may be and/or include a thumbscrew and/or a knob 52.

Motor coupling mechanism 14 and/or clamping mechanism 50 may be configured to couple to a variety of motor types, thereby accommodating various tiller 32 sizes and/or motor 30 shapes. For example, the clamping mechanism 50 and/or the clamp shell 82 may have and/or define an interior surface 58 (e.g., the interior may be a cavity, space, socket, and/or a hollow) that is configured to slip over, enclose, surround, gird, receive, abut, and/or cover at least a portion of the tiller of the motor. Interior surface 58 additionally or alternatively may be referred to as a tiller-engaging surface 58 of the clamping mechanism and/or clamp shell. To accommodate various motor types and tiller sizes (i.e., geometries, shapes, diameters, etc.), it is within the scope of the present disclosure that tiller extension handles 10 optionally may include and/or be utilized with a shim block 84. Generally, the shim block is associated with the motor coupling mechanism and/or the clamping mechanism. For example, the shim block may be coupled to the clamping mechanism, and/or the shim block may be independent of the clamping mechanism. Independent shim blocks may be in the form of a band, a sheet, a cuff, a sleeve, a wrap, a spacer, and/or a wedge, and may be elastomeric, plastic, and/or foam. Additionally or alternatively, shim blocks 84 may be selectively removable from and/or captive within the clamping mechanism. For example, the shim block may include, and/or may be, a body, a tongue, and/or a wedge coupled to the clamp shell and/or the fastener 22. When present, shim blocks may be positioned between the tiller and the motor coupling mechanism (e.g., the clamping mechanism, the clamp shell) to form at least a portion of the interface between the motor coupling mechanism and the tiller. For example, the interior surface 58 of the clamping mechanism 50 may be at least partially lined with the shim block. Stated in different terms, the shim block, when present, may form a portion of the interior surface 58 of the clamping mechanism 50.

The motor coupling mechanism 14, as with any part of the tiller extension handle 10, may be composed of one or more materials that are configured to withstand environmental exposure without significant degradation. While motor coupling mechanism 14 may be constructed to have a rigid, inflexible construction, it also is within the scope of the present disclosure that the motor coupling mechanism may be configured to elastically bend to accommodate various tiller handle sizes (e.g., bending to create a wider opening for larger handles and/or bending to create a narrower opening to fit smaller handles). For example, the motor coupling mechanism may include glass-filled and/or mineral-filled plastic, fiber-reinforced plastic (e.g., glass, aramid, and/or carbon fiber reinforced), and/or any of the tiller extension handle example materials disclosed herein.

While it is within the scope of the present disclosure that the tiller extension handle may be a rigid structure that generally retains a fixed, or predetermined, configuration, such as a linear configuration, it also is within the scope of the present disclosure that tiller extension handle 10 may include a flexible joint 16, interconnecting the shaft 12 and the motor coupling mechanism 14, that permits bending, or flexing, of at least a portion of the tiller extension handle relative to another portion of the tiller extension handle and/or the tiller itself. When present, flexible joint 16 may be between the motor coupling mechanism and at least a portion of the shaft. That is, the flexible joint may be directly and/or indirectly connected to the motor coupling mechanism. Additionally or alternatively, the flexible joint may be positioned along the shaft and/or coupled between two or more shaft members 70.

Use of a tiller extension handle 10 with a flexible joint 16 may provide the operator more freedom of movement such as for better weight distribution and/or more comfortable positioning while operating a watercraft. With a flexible joint, steering of the motor is controlled by a push-pull action rather than a wide steering arc required with a tiller extension handle without a flexible joint. With the push-pull action, the tiller extension handle is pulled away from the motor (toward the bow when the motor is coupled to the stern) to straighten the motor. To turn with the push-pull action, the operator may tilt, or arc, his arm and/or wrist to the port or starboard while pushing toward the motor (towards the stern when the motor is coupled to the stern).

Figure 2:
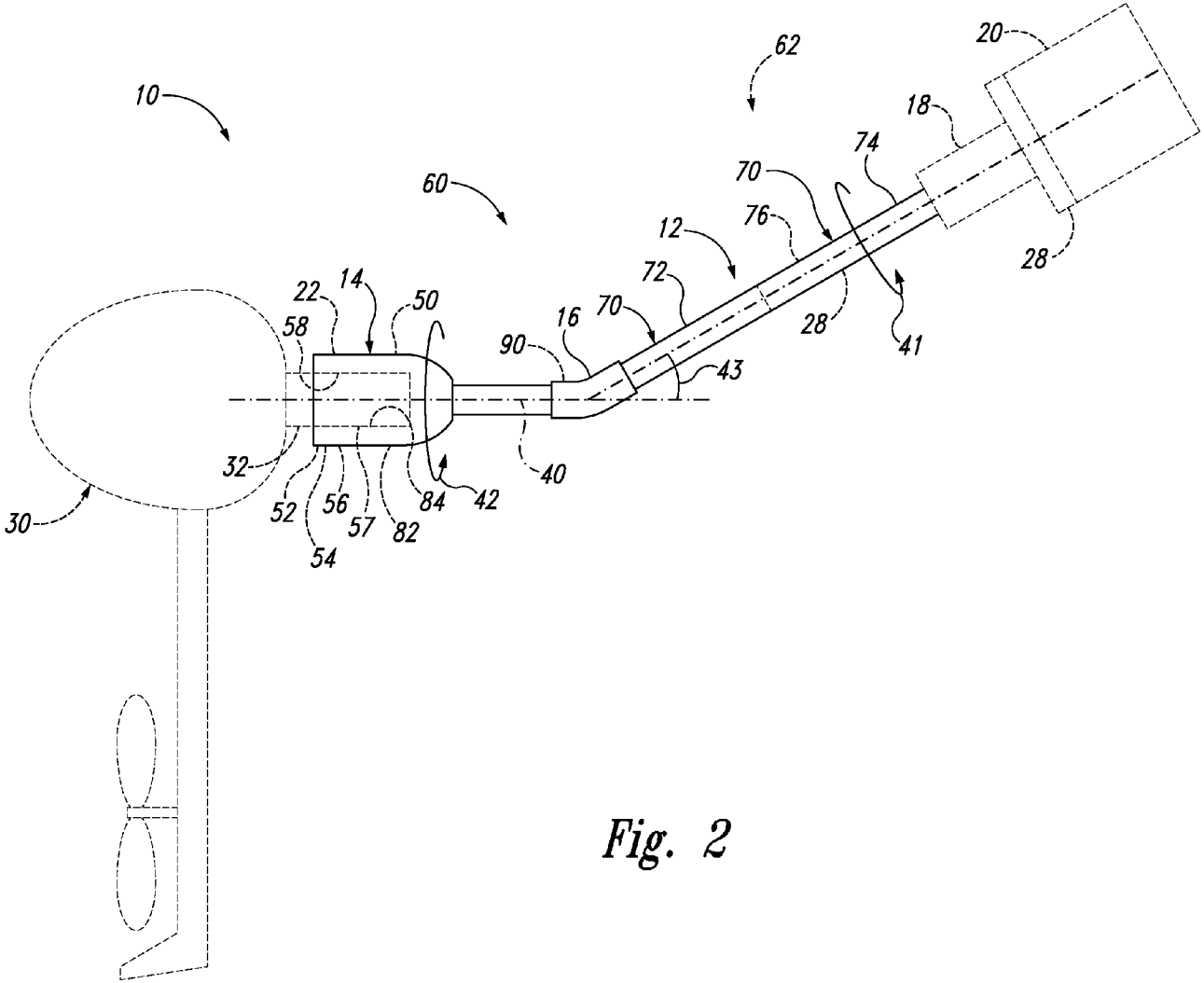
FIG. 2 is a schematic representation of tiller extension handles according to the present disclosure shown bent at an optional flexible joint.

Generally, the flexible joint 16 is configured to flex at any angle about the elongate direction 40 while having little flex when torsion is applied to the shaft 12 by the operator. For example, FIGS. 1-2 illustrate the transfer of the torsion 41 applied by the operator to a torsion 42 applied by the motor coupling mechanism to the motor's tiller 32. Where the motor 30 has a speed control adjusted through a twist to the tiller 32, a tiller extension handle 10 may allow adjustment of the speed control through the flexible joint if the flexible joint is sufficiently stiff in torsion.

As illustrated in FIG. 2, the bend angle 43 may be from 0° to about 160°, typically between 15° and 90°. The bend may be in any plane including the elongate direction 40 of the tiller extension handle, i.e., the plane of the FIG. 2 illustration may be horizontal, vertical, or any plane in between horizontal and vertical. Thus, the flexible joint 16 may be configured to bend in a conical range of angles subtending at least about 0.3π sr (steradians), at least about 2π sr, and/or about 4π sr (corresponding to cone half-apex angles of about 30°, about 90°, and about 160°, respectively).

Flexible joints 16 may have no bearing surfaces and/or no surfaces that move (slide and/or roll) across another surface. Flexible joints 16 may include, and/or may be, one or more unitary joints 90. Suitable flexible joints and/or unitary joints include flexure joints, tendon joints, rag joints, and/or living hinges. The flexible joint 16 may include one or more unitary joints 90 that are each independently generally cylindrical, hourglass-shaped, sheets, bands, cords, and/or cables. Alternatively, flexible joints 16 may include bearing, sliding, and/or rolling surfaces. For example, flexible joints 16 may include, and/or may be, a hinge, a link, a cross shaft, and/or a universal joint.

Flexible joints 16 may be configured to be weather resistant and resistant to fouling (including corrosion) common in marine environments. Flexible joints 16 with few to no bearing, sliding, or rolling surfaces (such as flexible joints that are and/or include unitary joints 90) may be less susceptible to fouling than flexible joints with more bearing, sliding, and/or rolling surfaces. Suitable materials for flexible joints 16 and unitary joints 90 include metals (e.g., aluminum, stainless steel, and/or magnesium), polymers, elastomers, rubber, silicone, latex, polyurethane, and/or composite materials (e.g., fiber-reinforced elastomers).

Returning to FIG. 1, when the tiller extension handle 10 includes the optional flexible joint 16, the tiller extension handle 10 also may include a joint lock-out device 24. The joint lock-out device is configured to selectively restrict the motion of the flexible joint, possibly completely restricting flexure of the flexible joint. Generally, the joint lock-out device has a locked configuration (configured to restrict motion of the flexible joint) and an unlocked configuration (configured to permit motion of the flexible joint). By restricting motion of the flexible joint, the tiller extension handle may be used as a rigid extension handle or an articulated extension handle at the discretion of the operator.

Joint lock-out devices 24 may be configured for ease of locking and unlocking. For example, the joint lock-out device may be configured to lock and to unlock the flexible joint without requiring the use of tools to lock or unlock the joint lock-out device. The joint lock-out device may include any suitable structure for selectively restricting flexing of the flexible joint, with examples including at least one bolt, pin, nut, clamp, hook, cam lock, twist lock, lever lock, snap lock, clamp lock, pin lock, guide, rod, and/or sleeve. For example, when joint lock-out device 24 includes a rigid member, such as a joint lock sleeve 25, the joint lock sleeve may be selectively extended around the flexible joint, and corresponding portions of the shaft 12 and/or motor coupling mechanism 14, to restrict flexing of the flexible joint. Additionally or alternatively, the joint lock-out device 24 may include a joint lock mechanism 86 that is configured to selectively engage and disengage the joint lock-out device, to retain the joint lock-out device in the locked configuration, to restrict motion of the flexible joint, to retain the joint lock-out device in the unlocked configuration, and/or to permit motion of the flexible joint. For example, joint lock mechanisms 86 may include, and optionally be, at least one of bolts, pins, nuts, clamps, hooks, buttons, cam locks, twist locks, lever locks, clamp locks, and/or pin locks.

Generally, the shaft 12 of the tiller extension handle 10 is an elongate body that is coupled to the motor coupling mechanism 14. For positional control of the motor, the tiller extension handle 10 may be relatively rigid along the elongate direction 40 of the tiller extension handle, i.e., configured to transmit a force applied at the end distal to the motor 30. Hence, the shaft 12 may be an elongated body that is sufficiently rigid to transmit the force required to turn without significant flexing while conveying inputs to the motor. For twist speed control, the tiller extension handle may be relatively stiff in torsion, thereby transmitting a twist at the end distal to the motor to the end proximal to the motor. Hence, the shaft 12 may be an elongated body that is sufficiently stiff to transmit the force required to operate the speed control of the motor.

Tiller extension handles 10 and/or shafts 12 may include, and/or be composed of, one or more shaft members 70 that are configured to operate together and that may be configured to repeatedly couple together and to separate. Shaft members 70 may include, and/or may be, rigid and/or stiff structures configured to form the shaft. For example, the shaft 12 and/or the shaft members 70 may include a solid structure or may define a shell or tubular structure with a profile that is hollow, open, and/or closed.

Figure 3:
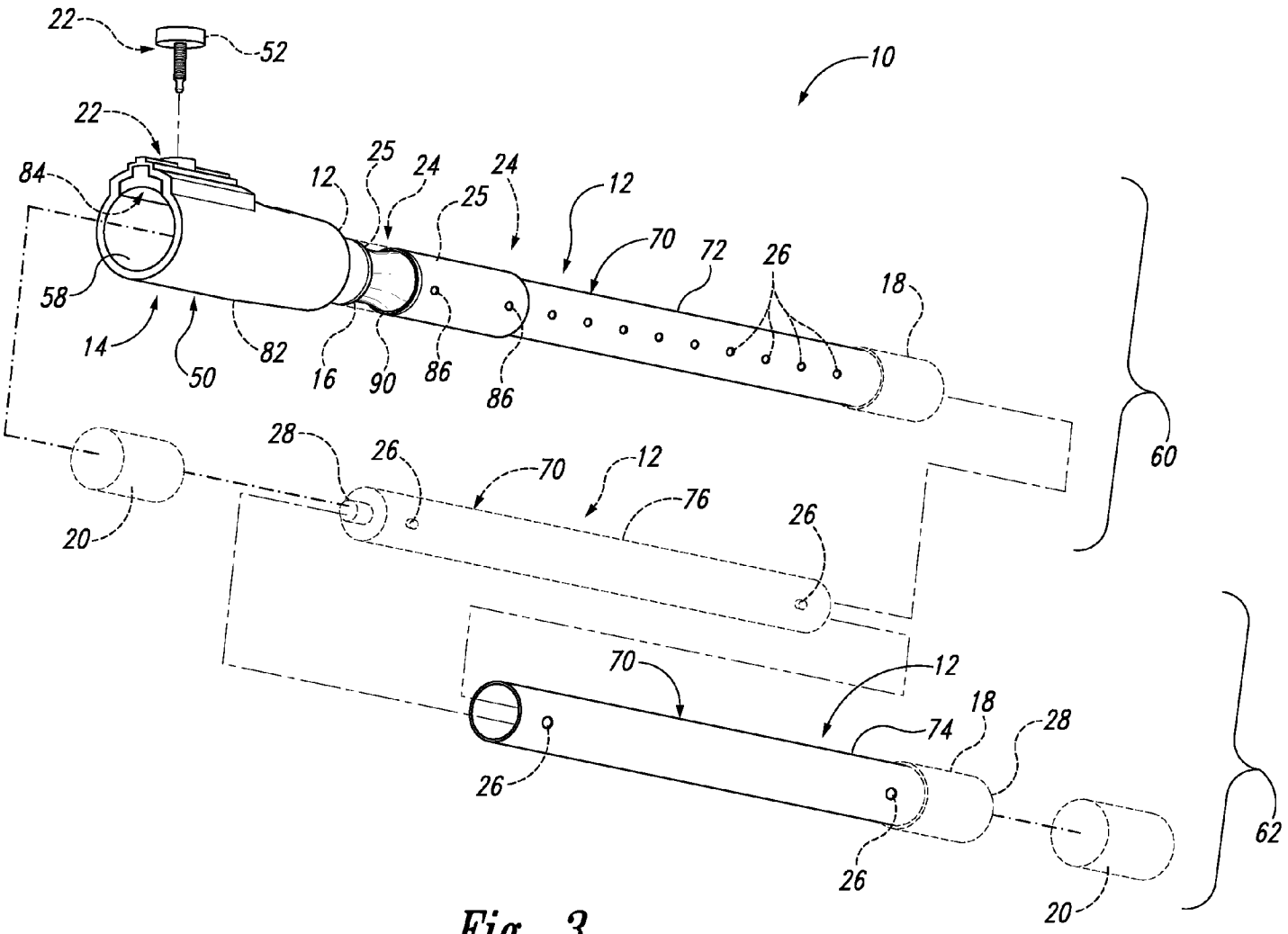
FIG. 3 is an exploded view of an example of a tiller extension handle according to the present disclosure.

As illustrated in FIG. 3, shafts 12 may include at least two, at least three, or more shaft members 70 (e.g., a tiller end shaft member 72, a handle extension shaft member 74, and one or more optional central extension shaft members 76). Generally, shaft members 70 are ordered, with the tiller end shaft member 72 connected, and/or configured to connect, to the motor coupling mechanism 14, with the handle extension shaft member 74 configured to connect to the tiller end shaft member 72 and/or a central extension shaft member 76, and with the optional central extension shaft member(s) configured to couple between the tiller end shaft member and the handle extension shaft member. The shaft members 70 may be segments and/or sections of the shaft 12. The shaft members 70 may fit together end to end. Additionally or alternatively, the shaft members 70 may be telescopic and/or nesting, where one shaft member fits into another. When the shaft members nest, the shaft members may be progressively smaller, progressively larger, alternating sizes, or any combination thereof. For example, the shaft members 70 may have tapered ends configured to fit into other shaft members. As another example, the tiller end shaft member 72 may be a tube with a diameter larger than the handle extension shaft member 74. In such an arrangement, an optional central extension shaft member 76 may have a diameter that is larger or smaller than the tiller end shaft member (hence, fitting around or within the tiller end shaft member) and that is larger or smaller than the handle end shaft member (hence, fitting around or within the handle end shaft member).

The shaft members 70 may be secured together by one or more shaft lock mechanisms 26. The shaft lock mechanisms 26 may be configured to secure and release the shaft members to/from one another. The shaft 12 may include one shaft lock mechanism 26 per shaft member 70, per shaft member pair, per shaft, and/or any other suitable number of shaft lock mechanisms. For example, one shaft lock mechanism 26 may be configured to secure two shaft members 70 together. As another example, one shaft lock mechanism 26 may be configured to secure three or more shaft members 70 together. A shaft lock mechanism 26 may be associated with and/or coupled to a single shaft member 70 when the shaft member is released from the other shaft members. Thus, the shaft member with an associated and/or coupled shaft lock mechanism may be configured to couple and/or to separate one or more other shaft members. For example, a central extension shaft member 76 may include a shaft lock mechanism (such as a pin lock) that is configured to couple the tiller end shaft member 72 and the handle extension shaft member 74 together. Shaft lock mechanisms 26 may include, and/or may be, at least one of a bolt, a pin, a nut, a clamp, a button, a cam lock, a twist lock, a lever lock, a snap lock, a clamp lock, and/or a pin lock.

The shaft 12 may be configured to be extensible, i.e., the shaft may have one or more different length configurations. Generally, an extensible shaft has one or more shaft members 70 that are configured to move relative to one another. For example, the shaft 12 may be telescopic and/or include shaft members 70 that are configured to slide, to fold, to nest, and/or to collapse relative to one another. For ease of use, the shaft may be adapted to be secured at each length configuration such that the member(s) do not move relative to one another during normal operation of the tiller extension handle. For example, the shaft 12 may include one or more shaft lock mechanisms 26 that are configured to secure the shaft members 70 in each length configuration. As an example, shaft lock mechanism 26 may be or include a pin lock with a spring-loaded pin (e.g., a button) configured to secure the shaft members at several length configurations, the shaft 12 may include shaft members 70 in the form of telescopic tubes in which an inner tube (a shaft member) includes a spring-loaded pin configured to engage one or more complementary holes spaced along the length of an outer tube (another shaft member).

As illustrated in the example of FIG. 3, tiller extension handles 10 may be configured to separate into sections and/or may include several separable sections, such as a tiller section 60 and an accessory section 62. The sections of the tiller extension handle 10 may be configured to separate while the motor coupling mechanism 14 is coupled to a tiller. For example, a tiller extension handle 10 incorporating a telescopic and/or nesting shaft 12 may separate at overlapping shaft members 70.

The tiller section 60 includes the motor coupling mechanism 14, at least a portion of the shaft 12 (e.g., a shaft member 70), and the optional flexible joint 16. The accessory section 62 includes at least a portion of the shaft 12 (e.g., at least one shaft member 70) and an accessory coupling mechanism 28 and/or an accessory 20 (as described further herein). For example, the tiller section 60 may include the motor coupling mechanism and a tiller end shaft member 72. As another example, the accessory section 62 may include a handle extension shaft member 74 and the accessory coupling mechanism 28 and/or the accessory 20. Additionally or alternatively, the accessory section 62 may not include an accessory coupling mechanism and/or an accessory because the accessory section itself may be the accessory (e.g., a pole, which may be a pole with a fractional tip or end region).

Figure 4:
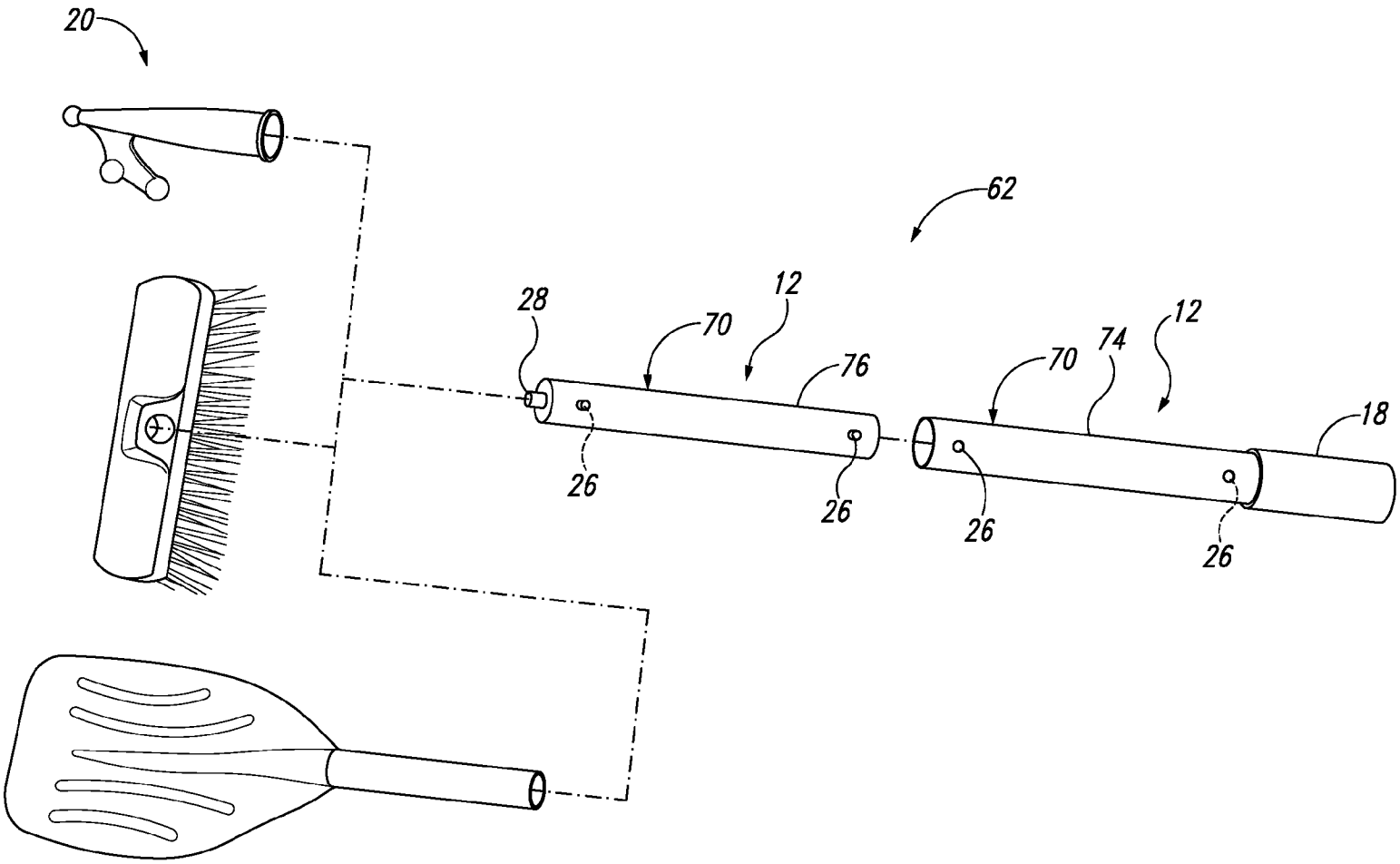
FIG. 4 is an exploded view of an example of an accessory section of a tiller extension handle according to the present disclosure.

As illustrated in the example of FIG. 3, the tiller extension handle 10, the tiller section 60, and the accessory section 62 may include shaft members 70 assembled together in different orientations and/or orders. In the example, the tiller extension handle may include a central extension shaft member 76 that couples the tiller end shaft member 72 to the handle extension shaft member 74. The shaft lock mechanism 26 is illustrated as a pin lock mechanism. The pin lock mechanism may include a pin in the central extension member 76, one or more holes in the tiller end shaft member 72, and one or more holes in the handle extension shaft member 74. When the tiller extension handle 10 is separated into the tiller section 60 and the accessory section 62, the central extension shaft member 76 may be a part of the tiller section (as indicated by the single short dash broken lines), a part of the accessory section (as indicated by the double short dash broken lines), or may not be a part of either section. As illustrated, the central extension shaft member 76 may include an accessory coupling mechanism 28 and/or an accessory 20 (described further herein). When the shaft members 70 of the tiller extension handle 10 are combined to form the complete tiller extension handle, the accessory coupling mechanism and/or the accessory of the central extension shaft member may be stowed within one of the other shaft members. As illustrated (following the single short dash broken lines), the accessory coupling mechanism 28 and/or the accessory 20 may be stowed within the handle extension shaft member. When the tiller extension handle is separated to form the tiller section and the accessory section, the end of the central extension shaft member 76 with the accessory coupling mechanism 28 and/or the accessory 20 is generally oriented away from the corresponding coupled shaft member (typically the handle extension shaft member 74) of the section (typically the accessory section). FIG. 4 illustrates an accessory section that includes the handle extension shaft member 74 and the central extension shaft member 76 oriented such that the accessory coupling mechanism 28 and/or accessory 20 of the central extension shaft member is oriented away from the handle extension shaft member 74 when the shaft members are coupled together.

Tiller extension handles 10, and/or the component parts thereof, may be configured to withstand, such as due to its construction and/or material(s) of construction, environmental exposure (e.g., use in a marine environment on a watercraft). For example, the tiller extension handle may be resistant to rust, weathering, and/or photodegradation (sun bleaching, UV-induced cracking, etc.). Examples of suitable materials include stainless steel, aluminum, magnesium, composite materials (e.g., fiber-filled and/or fiber-reinforced polymers and/or resins), plastics, and combinations thereof. As a more specific example, at least shaft 12 may include and/or be formed from a metal (e.g., aluminum, stainless steel, and/or magnesium), a plastic (e.g., nylon, polypropylene, polyurethane), a natural material (e.g., wood and/or bamboo), and/or a composite material, e.g., a material incorporating reinforcement fiber and/or filler.

The tiller extension handle 10 optionally may include and/or be adapted to selectively and/or interchangeably receive one or more accessories 20. As examples, accessory 20 may include a boat hook, a boat brush, a paddle, a net, a gaff, a pole, and/or other watercraft tools that typically include a handle. As such, shaft 12 of the tiller extension handle may function as this handle for such an attached accessory. Although not required, by combining the features of motor control and the accessory, the operator may save space on the watercraft and/or may be able to keep the watercraft tools organized. For example, the space saved by not holding a separate boat hook or brush may be used by carrying extra fishing equipment.

The accessory 20 may be permanently mounted to and/or even integral with, the tiller extension handle 10, the tiller section 60, the accessory section 62, and/or at least one of the shaft members 70. Alternatively, tiller extension handle 10 and/or components thereof may be configured to selectively and removably receive an accessory 20, which optionally may be configured to be coupled to the tiller extension handle. It is within the scope of the present disclosure that the accessory 20, when present, may be attached and/or coupled to any suitable portion of the tiller extension handle. Examples of suitable locations are shown in FIG. 3, indicated by dot-dash lines, and include the shaft 12, the tiller section 60, the accessory section 62, and/or one or more of the shaft members 70. The attached and/or coupled portion may be distal to the motor coupling mechanism 14 and/or at an end region of the shaft, a shaft member 70, the tiller section 60, and/or the accessory section 62.

When accessory 20 is not permanently attached to the tiller extension handle 10, the tiller extension handle 10 and/or accessory 20 may include an accessory coupling mechanism 28 that is configured to selectively couple the accessory to the shaft 12 or another portion of the tiller extension handle. It is within the scope of the present disclosure that the accessory coupling mechanism, when present, may be directly attached to, form a portion of, and/or otherwise be primarily associated with the accessory 20, the tiller extension handle 10, the shaft 12, a shaft member 70, the motor coupling mechanism 14, the tiller section 60, and/or the accessory section 62. Hence, the tiller extension handle 10 may be configured to accept and secure an accessory 20 at the motor coupling mechanism 14 (in which case, the accessory may be used when the motor is uncoupled), at the end of the tiller section 60 and/or the shaft 12 distal to the motor coupling mechanism (in which case, the accessory may be used while the motor is coupled or uncoupled, and/or while the accessory section, when present, is uncoupled), and/or at an end of the accessory section 62 (in which case, the accessory may be used while the motor is coupled or uncoupled, and/or while the accessory section is coupled or uncoupled). Likewise, the accessory 20 may be configured to couple to the tiller extension handle 10 at the motor coupling mechanism 14, at the end of the tiller section 60 and/or the shaft 12 distal to the motor coupling mechanism, and/or at an end of the accessory section 62.

The accessory coupling mechanism 28 may be configured for ease of coupling and uncoupling an accessory 20. For example, the accessory coupling mechanism may be configured to connect and to disconnect an accessory from the tiller extension handle 10, and to facilitate exchange of accessories, without any tools. As examples, accessory coupling mechanism 28 may include at least one bolt (e.g., a threaded shaft), pin, cam lock, twist lock, lever lock, snap lock, clamp lock, pin lock, spring, clamp, barb, taper, socket, receiver, threaded receiver, quick-release coupler, snap, strap, and/or similar coupling mechanism that is configured to selectively interconnect the accessory and the tiller extension handle.

Accessories 20 may be used when the tiller extension handle 10 is coupled to the motor 30 and/or may be used when the tiller extension handle is uncoupled from the motor. Further, the tiller extension handle 10 may be configured to selectively separate, as described further herein, into a tiller section 60 and an accessory section 62. When the tiller section is separated from the accessory section, the tiller section may be coupled to the motor, and the accessory section, optionally including the accessory, may be free of the motor.

Returning to FIG. 1, tiller extension handles 10 may include one or more hand grips 18 that are configured to provide an operator with a comfortable and/or secure grip on the tiller extension handle, a tiller extension handle section (e.g., tiller section 60 and/or accessory section 62), the shaft 12, a shaft member 70 (e.g., tiller end shaft member 72, handle extension shaft member 74, and/or central extension shaft member 76), and/or an accessory 20 while operating the motor 30 and/or using the accessory 20. The hand grip may be configured to be held comfortably for long periods of time, including while held in a twisted position to activate the motor speed control. Typically, a speed control is configured such that continued actuation by the operator is required for continued operation of the motor.

Hand grips 18 generally are located distal to the motor coupling mechanism 14 and/or distal to the accessory 20 (when coupled). For example, tiller extension handles 10 may include hand grips 18 at the end of the shaft 12 distal to the motor coupling mechanism, at the end of a shaft member 70, at the end of the tiller section 60 distal to the motor coupling mechanism 14, at either end of the accessory section 62, along the shaft 12, along any shaft member 70, along the tiller section 60, and/or along the accessory section 62. Additionally or alternatively, the entire length of the shaft, a shaft member 70, and/or a tiller extension handle section may include a hand grip 18.

Hand grips 18 may be configured to fit a hand of varying sizes, and/or may be contoured to fit an operator's hand, wrist, and/or arm in a natural position while operating the motor with the tiller extension handle (e.g., during steering and speed control). Further, hand grips 18 may be configured to dampen any undesired vibrations from the motor. Hand grips 18 may include an elastomeric portion, a pad, a contoured region, and/or a foam portion, which may aid operator comfort and vibration dampening. Additionally or alternatively, hand grips 18 may include materials suitable for construction of the tiller extension handle.

Examples of hand grip 18 configurations include a relatively straight configuration (where the hand grip is substantially collinear with the elongate direction 40 of the tiller extension handle 10), a curved configuration (where the hand grip curves out of the elongate direction), and a perpendicular configuration (where the hand grip includes a gripping portion substantially perpendicular to the elongate direction). Hand grips 18 may include an opening configured to accept a hand or portion thereof. For example, a hand grip 18 may have a D-shape.

Figure 5:
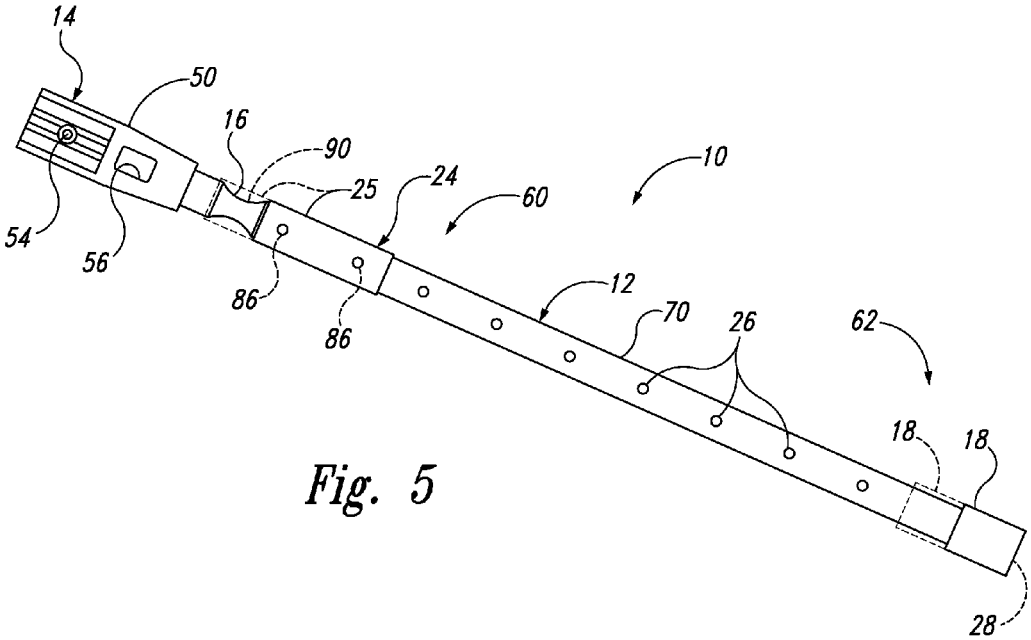
FIG. 5 is an elevation view of an example of a tiller extension handle according to the present disclosure, with a flexible joint and with a joint lock-out device.

FIG. 5 is an example of a tiller extension handle 10 incorporating (from left to right in the figure) a motor coupling mechanism 14, a flexible joint 16, a joint lock-out device 24 (illustrated as a joint lock sleeve 25), a telescopic shaft 12 with a shaft lock mechanism 26, at least one hand grip 18, and an optional accessory coupling mechanism 28. The motor coupling mechanism 14 is a clamping mechanism 50 that includes a fastener receiver 54 and a tiller access window 56. The flexible joint 16 is a unitary joint 90 that is an hourglass-design, tendon joint including an elastomeric tendon (a flexible linkage 92 as described further herein with respect to FIGS. 8-9).

The joint lock sleeve 25 is a rigid sleeve configured to slide over at least a portion of the shaft 12 to form the unlocked configuration (as illustrated in solid line in FIG. 5), leaving the flexible joint 16 unimpaired. The joint lock sleeve 25 also is configured to rigidly couple the shaft 12 to the motor coupling mechanism 14 to form the locked configuration (as illustrated in dashed line), operationally eliminating the flexible joint. In FIG. 5, the shaft 12 is connected to one end of the flexible joint 16 and the motor coupling mechanism 14 is connected to the other end of the flexible joint (via a tubular portion of the motor coupling mechanism). In the locked configuration, the joint lock sleeve 25 spans the flexible joint 16 and retains the shaft 12 and motor coupling mechanism 14 in a collinear relationship.

The joint lock sleeve 25 is selectively retained in the unlocked configuration or the locked configuration by a joint lock mechanism 86 (illustrated as a pin lock). For example, the joint lock mechanism 86 may include a spring-loaded pin (e.g., a button) in the shaft 12 at the left end of the joint lock sleeve 25 (as illustrated) and a hole at each end of the joint lock sleeve 25, each hole being sized to engage the pin. In the unlocked configuration, the pin is engaged in one of the holes (the first hole, at the left end of the joint lock sleeve). In the locked configuration (as illustrated in dashed line), the pin is engaged in the other hole (the second hole, at the right end of the joint lock sleeve). To transition the joint lock sleeve 25 from the unlocked configuration to the locked configuration, the operator may (1) press the pin to disengage it from the first hole and to free the joint lock sleeve, (2) slide the joint lock sleeve over the flexible joint 16 to engage the tubular portion of the motor coupling mechanism 14, and (3) engage the pin in the second hole.

Figure 6:
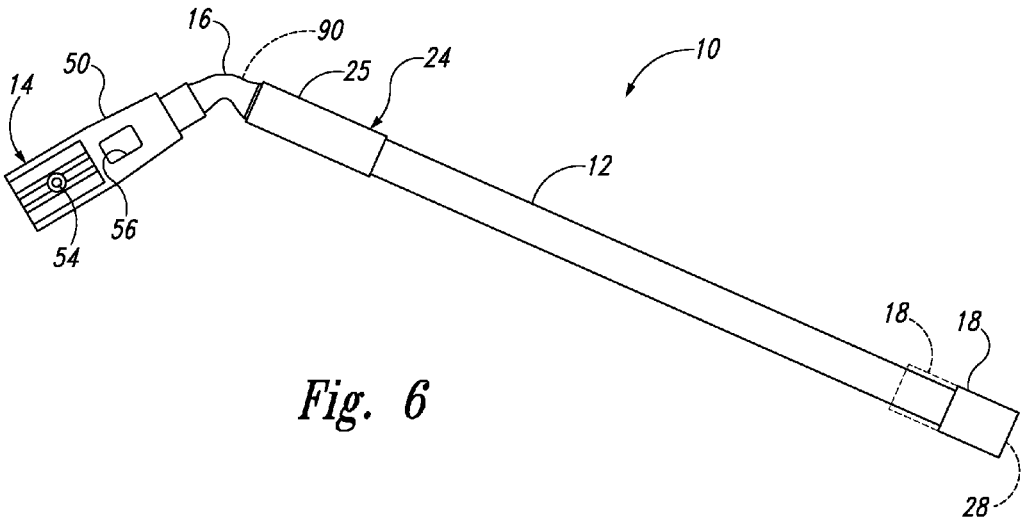
FIG. 6 is an elevation view of the tiller extension handle of FIG. 5 in a bent configuration.

The shaft lock mechanism 26 includes a pin lock that includes a series of holes in an outer tube-shaped shaft member 70 of the telescopic shaft 12 and includes a spring-biased pin (e.g., a button) in an inner tube-shaped shaft member 70 that is configured to engage one of the holes. In FIG. 5, the outer shaft member 70 covers the inner shaft member 70 and, hence, the inner shaft member 70 is not visible in the figure. When the pin engages one of the holes of the outer shaft member 70, the shaft members 70 of the telescopic shaft 12 are restricted from moving relative to one another. To free the telescopic shaft members 70 (e.g., to separate into the tiller section 60 and the accessory section 62) and/or to reset the shaft 12 to a different length, the operator may depress the pin and slide the shaft members 70 relative to one another. FIG. 6 is a view of the tiller extension handle 10 of FIG. 5 in a bent configuration, i.e., the flexible joint 16 is bent at an angle of about 45°.

Figure 7:
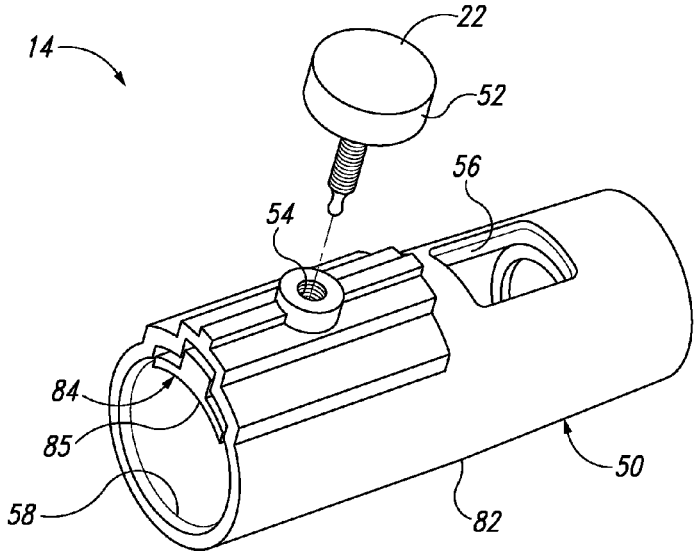
FIG. 7 is a partially exploded view of an example of a motor coupling mechanism that may be used in tiller extension handles according to the present disclosure.

FIG. 7 is a detailed view of an example of a motor coupling mechanism 14. The motor coupling mechanism includes a clamping mechanism 50 with a fastener receiver 54 (e.g., a threaded bore) configured to receive a fastener 22 (e.g. a thumbscrew), a tiller access window 56 configured to allow access to tiller controls (e.g., a kill switch), and a clamp shell 82 configured to receive a tiller 32. In FIG. 7, the tiller would be inserted into the clamp shell from the left. The clamp shell 82 may be configured to receive and/or to fit differently sized tillers with or without a shim block 84. As illustrated, the clamp shell 82 may have a fixed interior (with a given diameter generally larger than a tiller) and the fastener 22 may be configured to axially compress the tiller into an interior surface 58 of the clamp shell. When securing the tiller, the fastener 22 may press against the tiller 32 and/or against the shim block 84 between the tiller and the fastener. The shim block 84 may be a tip of the fastener 22, captive and/or retained at the end of the fastener 22, and/or may be captive and/or retained within the clamp shell 82. Additionally or alternatively, the shim block 84 and/or the interior surface 58 of the clamp shell may include a guide, a ridge, a rib, and/or a groove to at least assist the alignment of the shim block 84 between the fastener, the clamp shell, and the tiller. The interior surface 58 of the clamp shell, the shim block 84 (in particular an engagement surface 85), and/or the fastener 22 may be configured to avoid damage to and/or marring of the tiller. For example, the interior surface, the shim block, the engagement surface, and/or the fastener may include, and/or may be, a soft material, a soft coating, an elastomeric material, a foam material, and/or a pad.

Figure 8:
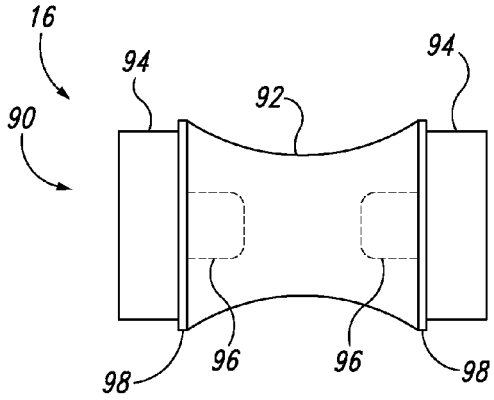
FIG. 8 is an elevation view of an example of a unitary joint in a neutral position.
Figure 9:
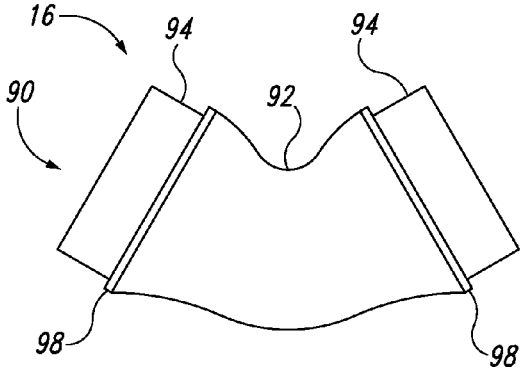
FIG. 9 is an elevation view of the unitary joint of FIG. 8 in a flexed position.

FIGS. 8-9 are views of an example of a unitary joint 90. The unitary joint 90 may be, and/or may include, a monolithic elastomeric part, such as a flexible linkage 92. Unitary joints and/or flexible linkages are configured to repeatedly flex. The illustrated unitary joint 90 and flexible linkage 92 have hourglass shapes and are elongated perpendicular to the hourglass waist. The elongate direction of the unitary joint and/or the elongate direction of the flexible linkage may be generally aligned with the elongate direction of the tiller extension handle 10. The unitary joint and/or the flexible linkage is configured to flex over a range of angles as indicated by the example bent configuration illustrated in FIG. 9.

The unitary joint 90 may include one or more rigid linkages 94 at one or more ends of the unitary joint. Unitary joints and/or rigid linkages are configured to couple to one or more of a shaft 12, a shaft member 70, a motor coupling mechanism 14, and a hand grip 18. Additionally, rigid linkages are configured to couple to the flexible linkage 92. For example, the illustrated rigid linkages 94 include a cylindrical end configured to fit into a tubular end of a shaft member 70 and/or the motor coupling mechanism 14. The illustrated rigid linkages also include a rigid flange 98 between the cylindrical end and the flexible linkage. The flange 98 is configured to locate the coupled shaft member 70 and/or motor coupling mechanism 14, and configured to separate and/or protect the flexible linkage from the shaft member and/or motor coupling mechanism. Further, the rigid linkages 94 may include a coupling surface 96 that may be configured to facilitate coupling between the rigid linkage and the flexible linkage. The coupling surfaces 96 in FIG. 8 are illustrated as including posts which may facilitate insert molding, overmolding, and/or bonding of the flexible linkage and the rigid linkage. Additionally or alternatively, coupling surfaces 96 may include posts, sockets, grooves, channels, roughened surfaces, smooth surfaces, concavities, and/or convexities.

Examples of tiller extension handles 10 according to the present disclosure are described in the following enumerated paragraphs:

A1. A tiller extension handle, comprising:

a motor coupling mechanism configured to selectively couple the tiller extension handle to a tiller; and a shaft connected to the motor coupling mechanism; and an accessory coupling mechanism connected to the shaft and configured to selectively couple an accessory to the shaft.

A1.1. The tiller extension handle of paragraph A1, further comprising the accessory coupled to the accessory coupling mechanism.

A1.2. The tiller extension handle of any of paragraphs A1-A1.1, wherein the accessory coupling mechanism includes, optionally is, at least one of a threaded shaft, a snap, a strap, and a clamp.

A1.3. The tiller extension handle of any of paragraphs A1-A1.2, wherein the accessory coupling mechanism is connected to the shaft distal to the motor coupling mechanism.

A2. A tiller extension handle, comprising:

a motor coupling mechanism configured to selectively couple the tiller extension handle to a tiller;

a shaft connected to the motor coupling mechanism; and an accessory connected to the shaft.

A2.1. The tiller extension handle of paragraph A2, wherein the accessory is permanently attached to the shaft.

A2.2. The tiller extension handle of any of paragraphs A2-A2.1, wherein the accessory is configured to be selectively removed from and reattached to the shaft.

A2.3. The tiller extension handle of any of paragraphs A2-A2.2, wherein the accessory is connected to the shaft distal to the motor coupling mechanism.

A3. The tiller extension handle of any of paragraphs A1-A2.3, wherein the accessory includes, optionally is, at least one of a boat hook, a boat brush, a paddle, a net, a gaff, and a pole.

A3.1. The tiller extension handle of paragraph A3, wherein the accessory is selected from the group consisting of a boat hook, a boat brush, a paddle, a net, and a gaff.

A4. The tiller extension handle of any of paragraphs A1-A3.1, wherein the tiller extension handle is configured to separate into a tiller section and an accessory section, optionally while the motor coupling mechanism is coupled to the tiller.

A4.1. The tiller extension handle of paragraph A4, wherein the tiller section includes the motor coupling mechanism.

A4.1.1. The tiller extension handle of paragraph A4.1, wherein the tiller section includes a hand grip distal to the motor coupling mechanism.

A4.2. The tiller extension handle of any of paragraphs A4-A4.1.1, wherein the tiller section includes a the hand grip and/or the accessory section includes a hand grip.

A4.3. The tiller extension handle of any of paragraphs A4-A4.2, wherein the accessory section includes the accessory and/or a/the accessory coupling mechanism.

A4.4. The tiller extension handle of any of paragraphs A4-A4.3, wherein the accessory section includes a/the hand grip distal to the accessory and/or a/the accessory coupling mechanism.

A5. The tiller extension handle of any of paragraphs A1-A4.4, wherein the shaft includes at least two rigid conformations of different lengths.

A6. The tiller extension handle of any of paragraphs A1-A5, wherein the shaft includes at least one shaft lock mechanism configured to lock the shaft into a rigid conformation, and optionally wherein the shaft lock mechanism includes, and/or is, at least one of a cam lock, a twist lock, a lever lock, a snap lock, a clamp lock, and a pin lock.

A7. The tiller extension handle of any of paragraphs A1-A6, wherein the shaft is configured to transition between at least two rigid conformations of different lengths.

A8. The tiller extension handle of any of paragraphs A1-A7, wherein the shaft is at least one of a telescopic shaft and a tubular shaft.

A9. The tiller extension handle of any of paragraphs A1-A8, wherein the shaft includes a series of nesting shaft members.

A10. The tiller extension handle of any of paragraphs A1-A9, wherein the shaft includes a tiller end shaft member, a handle extension shaft member, and optionally includes a central extension shaft member.

A10.1. The tiller extension handle of paragraph A10, wherein the tiller end shaft member and the handle extension shaft member are configured to repeatedly couple together and to separate.

A10.1.1. The tiller extension handle of paragraph A10.1, wherein the tiller end shaft member and the handle extension shaft member are configured to lock together with a shaft lock mechanism, and optionally wherein the shaft lock mechanism includes, and/or is, at least one of a cam lock, a twist lock, a lever lock, a snap lock, a clamp lock, and a pin lock.

A10.2. The tiller extension handle of any of paragraphs A10-A10.1.1, wherein the tiller end shaft member and the central extension shaft member are configured to repeatedly couple together and to separate, and/or wherein the central extension shaft member and the handle extension shaft member are configured to repeatedly couple together and to separate.

A10.2.1. The tiller extension handle of paragraph A10.2, wherein the tiller end shaft member and the central extension shaft member are configured to lock together with a/the shaft lock mechanism, and optionally wherein the shaft lock mechanism includes, and/or is, at least one of a cam lock, a twist lock, a lever lock, a snap lock, a clamp lock, and a pin lock.

A10.2.2. The tiller extension handle of any of paragraphs A10.2-A10.2.1, wherein the central extension shaft member and the handle extension shaft member are configured to lock together with a/the shaft lock mechanism, and optionally wherein the shaft lock mechanism includes, and/or is, at least one of a cam lock, a twist lock, a lever lock, a snap lock, a clamp lock, and a pin lock.

A10.3. The tiller extension handle of any of paragraphs A10-A10.2.2, wherein the central extension shaft member is configured to couple and to separate the tiller end shaft member and the handle extension shaft member.

A10.4. The tiller extension handle of any of paragraphs A10-A10.3, wherein the tiller end shaft member is connected to the motor coupling mechanism and optionally includes a/the hand grip distal to the motor coupling mechanism.

A10.5. The tiller extension handle of any of paragraphs A10-A10.4, wherein the tiller end shaft member includes a/the hand grip and/or the handle extension end includes a/the hand grip.

A10.6. The tiller extension handle of any of paragraphs A10-A10.5, wherein the handle extension shaft member includes an/the accessory coupling mechanism and optionally includes a/the hand grip distal to the accessory coupling mechanism.

A10.6.1. The tiller extension handle of paragraph A10.6, wherein the accessory coupling mechanism is interior to the tiller end shaft member when the handle extension shaft member is coupled to the tiller end shaft member.

A10.7. The tiller extension handle of any of paragraphs A10-A10.6.1, wherein the central extension shaft member includes an/the accessory coupling mechanism.

A10.7.1. The tiller extension handle of paragraph A10.7, wherein the accessory coupling mechanism is interior to the handle extension shaft member when the central extension shaft member is coupled to the handle extension shaft member.

A10.7.2. The tiller extension handle of any of paragraphs A10.7-A10.7.1, wherein the accessory coupling mechanism is interior to the tiller end shaft member when the central extension shaft member is coupled to the tiller end shaft member.

A10.8. The tiller extension handle of any of paragraphs A10-A10.7.2, wherein the central extension shaft member is configured to fit within the tiller end shaft member and/or the handle extension shaft member.

A11. The tiller extension handle of any of paragraphs A1-A10.8, wherein the tiller is the tiller of a motor configured to propel a watercraft with a thrust.

A11.1. The tiller extension handle of paragraph A11, wherein the shaft is configured to control a speed of the motor with a twisting motion.

A11.2. The tiller extension handle of any of paragraphs A11-A11.1, wherein the shaft is configured to change a direction of the thrust of the motor.

A12. The tiller extension handle of any of paragraphs A1-A11.2, wherein the tiller extension handle further comprises a flexible joint interconnecting the shaft and the motor coupling mechanism.

A12.1. The tiller extension handle of paragraph A12, wherein the flexible joint is directly and/or indirectly connected to the motor coupling mechanism.

A12.2. The tiller extension handle of any of paragraphs A12-A12.1, wherein the flexible joint includes, optionally is, at least one of a hinge, a link, a cross shaft, and a universal joint.

A12.3. The tiller extension handle of any of paragraphs A12-A12.2, wherein the flexible joint includes, optionally is, at least one unitary joint.

A12.3.1. The tiller extension handle of paragraph A12.3, wherein the unitary joint is at least one of a flexure joint, a tendon joint, a rag joint, and a living hinge.

A12.3.2. The tiller extension handle of any of paragraphs A12.3-A12.3.1, wherein the unitary joint includes an elastomeric linkage, optionally at least substantially in the form of a cylinder, an hourglass, a sheet, a band, a cord, or a cable.

A12.3.3. The tiller extension handle of any of paragraphs A12.3-A12.3.2, wherein the unitary joint includes two ends and a rigid linkage at each of the two ends.

A12.4. The tiller extension handle of any of paragraphs A12-A12.3.3, further comprising a joint lock-out device configured to selectively restrict motion of the flexible joint.

A12.4.1. The tiller extension handle of paragraph A12.4, wherein the joint lock-out device has a locked configuration, in which motion of the flexible joint is restricted, and an unlocked configuration, in which motion of the flexible joint is permitted.

A12.4.2. The tiller extension handle of any of paragraphs A12.4-A12.4.1, wherein the joint lock-out device includes a joint lock mechanism configured to retain the joint lock-out device in a/the locked configuration and/or to retain the joint lock-out device in an/the unlocked configuration, and optionally wherein the joint lock mechanism includes, and/or is, at least one of a cam lock, a twist lock, a lever lock, a snap lock, a clamp lock, and a pin lock.

A13. The tiller extension handle of any of paragraphs A1-A12.4.2, wherein the shaft includes a/the hand grip distal to the motor coupling mechanism.

A14. The tiller extension handle of any of paragraphs A1-A13, wherein the motor coupling mechanism includes a clamp shell, a fastener, and a shim block captive on the fastener.

A14.1. The tiller extension handle of paragraph A14, wherein the fastener is configured to apply radial pressure to the tiller to secure the tiller in the clamp shell.

A14.2. The tiller extension handle of any of paragraphs A14-A14.1, wherein the shim block is configured to be positioned between the fastener and the tiller in the clamp shell.

A14.3. The tiller extension handle of any of paragraphs A14-A14.2, wherein the shim block includes an engagement surface configured to avoid damage to and/or marring of the tiller in the clamp shell.

A14.4. The tiller extension handle of any of paragraphs A14-A14.3, wherein the clamp shell includes an access window configured to access a control on the tiller in the clamp shell.

B1. A tiller extension handle, comprising:

a motor coupling mechanism configured to selectively couple the tiller extension handle to a tiller;

a shaft; and a unitary joint interconnecting the shaft and the motor coupling mechanism.

B1.1. The tiller extension handle of paragraph B1, wherein the unitary joint is directly and/or indirectly connected to the motor coupling mechanism.

B1.2. The tiller extension handle of any of paragraphs B1-B1.1, wherein the unitary joint is at least one of a flexure joint, a tendon joint, a rag joint, and a living hinge.

B1.3. The tiller extension handle of any of paragraphs B1-B1.2, wherein the unitary joint is at least partially composed of at least one of a metal, aluminum, stainless steel, magnesium, a polymer, an elastomer, rubber, silicone, latex, polyurethane, a composite material, and a fiber-reinforced elastomer.

B2. The tiller extension handle of any of paragraphs B1-B1.3, wherein the tiller extension handle includes a plurality of unitary joints.

B3. The tiller extension handle of any of paragraphs B1-B2, wherein the unitary joint includes an elastomeric linkage, optionally at least substantially in the form of a cylinder, an hourglass, a sheet, a band, a cord, or a cable.

B4. The tiller extension handle of any of paragraphs B1-B3, wherein the unitary joint includes two ends and a rigid linkage at each of the two ends.

B5. The tiller extension handle of any of paragraphs B1-B4, further comprising a joint lock-out device configured to selectively restrict motion of the unitary joint.

B5.1. The tiller extension handle of paragraph B5, wherein the joint lock-out device has a locked configuration, in which motion of the unitary joint is restricted, and an unlocked configuration, in which motion of the unitary joint is permitted.

B5.2. The tiller extension handle of any of paragraphs B5-B5.1, wherein the joint lock-out device includes a joint lock mechanism configured to retain the joint lock-out device in a/the locked configuration and/or to retain the joint lock-out device in an/the unlocked configuration, and optionally wherein the joint lock mechanism includes, and/or is, at least one of a cam lock, a twist lock, a lever lock, a snap lock, a clamp lock, and a pin lock.

B6. The tiller extension handle of any of paragraphs B1-B5.2, wherein the shaft is the shaft of any of paragraphs A1-A14.4 and/or wherein the motor coupling mechanism is the motor coupling mechanism of any of paragraphs A1-A14.4.

B7. The tiller extension handle of any of paragraphs B1-B6, wherein the tiller extension handle is configured to separate into a tiller section and an accessory section, optionally while the motor coupling mechanism is coupled to the tiller.

B7.1. The tiller extension handle of paragraph B7, wherein the tiller section includes the motor coupling mechanism and the unitary joint.

B7.1.1. The tiller extension handle of paragraph B7.1, wherein the tiller section includes a hand grip distal to the motor coupling mechanism.

B7.2. The tiller extension handle of any of paragraphs B7-B7.1.1, wherein the tiller section includes a/the hand grip and/or the accessory section includes a hand grip.

B7.3. The tiller extension handle of any of paragraphs B7-B7.2, wherein the accessory section includes an accessory and/or an accessory coupling mechanism.

B7.3.1. The tiller extension handle of paragraph B7.3, wherein the accessory section includes a/the hand grip distal to the accessory and/or the accessory coupling mechanism.

B8. The tiller extension handle of any of paragraphs B1-B7.3.1, further comprising an/the accessory coupling mechanism.

B8.1. The tiller extension handle of paragraph B8, wherein the accessory coupling mechanism is configured to couple the tiller extension handle to at least one of a boat hook, a boat brush, a paddle, a net, a gaff, and a pole.

B8.2. The tiller extension handle of any of paragraphs B8-B8.1, further comprising an/the accessory coupled to the accessory coupling mechanism, wherein the accessory includes at least one of a boat hook, a boat brush, a paddle, a net, a gaff, and a pole.

B8.3. The tiller extension handle of any of paragraphs B8-B8.2, wherein the accessory coupling mechanism includes, optionally is, at least one of a bolt, a pin, a cam lock, a twist lock, a lever lock, a snap lock, a clamp lock, a pin lock, a spring, a clamp, a barb, a taper, a socket, a receiver, a threaded receiver, a quick-release coupler, a snap, and a strap.

B8.4. The tiller extension handle of any of paragraphs B8-B8.3, wherein the accessory coupling mechanism is connected to the shaft distal to the motor coupling mechanism.

B9. The tiller extension handle of any of paragraphs B1-B8.4, further comprising an/the accessory coupled to the shaft, wherein the accessory includes at least one of a boat hook, a boat brush, a paddle, a net, a gaff, and a pole, and optionally wherein the accessory is coupled to the tiller extension handle distal to the motor coupling mechanism.

B10. The tiller extension handle of any of paragraphs B1-B9, further comprising an/the accessory coupled to the tiller extension handle with the motor coupling mechanism.

B11. The tiller extension handle of any of paragraphs B1-B10, wherein the tiller is the tiller of a motor configured to propel a watercraft with a thrust.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

In the event that any patents or patent applications are incorporated by reference herein and (1) define a term in a manner and/or (2) are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the boating and marine industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure, the preceding numbered paragraphs, or subsequently filed claims recite "a" or "a first" element or the equivalent thereof, such claims should be understood to include incorporation of one or more such elements, neither requiring nor excluding two or more such elements.

The invention claimed is:

1. A tiller extension handle, comprising:

a motor coupling mechanism configured to selectively couple the tiller extension handle to a tiller; and a shaft connected to the motor coupling mechanism, wherein the shaft includes a tiller end shaft member, a handle extension shaft member, and a shaft lock mechanism that is configured to repeatedly couple together and permit selective separation of the tiller end shaft member and the handle extension shaft member; and an accessory coupling mechanism connected to the shaft and configured to selectively couple an accessory to the shaft, wherein the tiller end shaft member is connected to the motor coupling mechanism and wherein the handle extension shaft member includes the accessory coupling mechanism.

2. The tiller extension handle of claim 1, wherein the tiller extension handle is configured to separate into a tiller section and an accessory section, wherein the tiller section includes the motor coupling mechanism, and wherein the accessory section includes the accessory mechanism.

3. The tiller extension handle of claim 1, wherein the shaft is a telescopic shaft.

4. The tiller extension handle of claim 1, wherein the shaft includes a central extension shaft member that is coupled to at least one of the tiller end shaft member and the handle extension shaft member.

5. The tiller extension handle of claim 4, wherein the central extension shaft member includes the accessory coupling mechanism, wherein the handle extension shaft member and the central extension shaft member are coupled together to form an accessory section that is configured to be selectively separated from the tiller end shaft member, wherein the accessory coupling mechanism is located on an end of the central extension shaft member that is distal the handle extension shaft member when the central extension shaft member and the handle extension shaft member form the accessory section, and wherein the accessory coupling mechanism is interior to at least one of the tiller end shaft member and the handle extension shaft member when the tiller end shaft member is coupled to the handle extension shaft member.

6. The tiller extension handle of claim 1, wherein the tiller extension handle further comprises a flexible joint interconnecting the shaft and the motor coupling mechanism.

7. The tiller extension handle of claim 6, wherein the flexible joint includes at least one unitary joint.

8. The tiller extension handle of claim 6, further comprising a joint lock-out device configured to selectively restrict motion of the flexible joint, wherein the joint lock-out device has a locked configuration, in which motion of the flexible joint is restricted, and an unlocked configuration, in which motion of the flexible joint is permitted.

9. The tiller extension handle of claim 1, further comprising the accessory coupled to the shaft, wherein the accessory is selected from the group consisting of a boat hook, a boat brush, a paddle, a net, and a gaff.

10. A tiller extension handle, comprising:

a motor coupling mechanism configured to selectively couple the tiller extension handle to a tiller;

a shaft; and a flexible unitary joint interconnecting the shaft and the motor coupling mechanism, wherein the unitary joint includes an elastomeric linkage, two ends, and a rigid linkage at each of the two ends.

11. The tiller extension handle of claim 10, further comprising a joint lock-out device configured to selectively restrict motion of the unitary joint.

12. The tiller extension handle of claim 10, wherein the tiller extension handle is configured to separate into a tiller section and an accessory section, wherein the tiller section includes the motor coupling mechanism and the unitary joint.

13. The tiller extension handle of claim 12, wherein the accessory section includes a shaft member and an accessory coupling mechanism configured to selectively couple an accessory to the shaft member.

14. The tiller extension handle of claim 13, further comprising the accessory coupled to the shaft, wherein the accessory is selected from the group consisting of a boat hook, a boat brush, a paddle, a net, and a gaff.

15. The tiller extension handle of claim 10, wherein the shaft is a telescopic shaft.

16. The tiller extension handle of claim 10, wherein the shaft includes a tiller end shaft member, a handle extension shaft member, and a shaft lock mechanism that is configured to repeatedly couple together and permit selective separation of the tiller end shaft member and the handle extension shaft member.

17. The tiller extension handle of claim 16, wherein the tiller end shaft member is connected to the motor coupling mechanism and the unitary joint.

18. The tiller extension handle of claim 16, wherein the shaft includes a central extension shaft member that is coupled to at least one of the tiller end shaft member and the handle extension shaft member.

19. A tiller extension handle, comprising:

a motor coupling mechanism configured to selectively couple the tiller extension handle to a tiller;

a shaft, wherein the shaft includes a tiller end shaft member and a handle extension shaft member that are configured to repeatedly couple together and to separate, wherein the shaft includes a central extension shaft member that is coupled to at least one of the tiller end shaft member and the handle extension shaft member, wherein the central extension shaft member includes an accessory coupling mechanism configured to selectively couple an accessory to the central extension shaft member, wherein the handle extension shaft member and the central extension shaft member are coupled together to form an accessory section that is configured to be selectively separated from the tiller end shaft member, wherein the accessory coupling mechanism is located on an end of the central extension shaft member that is distal the handle extension shaft member when the central extension shaft member and the handle extension shaft member form the accessory section, and wherein the accessory coupling mechanism is interior to at least one of the tiller end shaft member and the handle extension shaft member when the tiller end shaft member is coupled to the handle extension shaft member; and a unitary joint interconnecting the shaft and the motor coupling mechanism.

20. The tiller extension handle of claim 10, wherein the motor coupling mechanism includes a clamp shell, a fastener, and a shim block captive on the fastener.

21. The tiller extension handle of claim 1, wherein the motor coupling mechanism includes a clamp shell, a fastener, and a shim block captive on the fastener.

22. The tiller extension handle of claim 7, further comprising the accessory coupled to the shaft, wherein the accessory is selected from the group consisting of a boat hook, a boat brush, a paddle, a net, and a gaff.

23. The tiller extension handle of claim 19, further comprising the accessory coupled to the central extension shaft member, wherein the accessory is selected from the group consisting of a boat hook, a boat brush, a paddle, a net, and a gaff.

24. The tiller extension handle of claim 19, wherein the shaft further includes a shaft lock mechanism that is configured to repeatedly couple together and to permit selective separation of the tiller extension shaft member and the handle extension shaft member.

* * * * *

UNITED STATES PATENT AND TRADEMARK OFFICE

CERTIFICATE OF CORRECTION

PATENT NO. : 9,493,221 B2
APPLICATION NO. : 14/499601
DATED : November 15, 2016
INVENTOR(S) : Dale M. Cordell It is certified that error appears in the above-identified patent and that said Letters Patent is hereby corrected as shown below:

In the Claims

Column 20, Line 52, after "accessory section includes the accessory" please insert --coupling--.

Signed and Sealed this
Tenth Day of January, 2017

Michelle K. Lee

Michelle K. Lee
*Director of the United States Patent and Trademark Office*